United States Patent [19]

Korba

[11] 4,026,621

[45] May 31, 1977

[54] TIMING LIGHT ADAPTOR

[76] Inventor: Michael A. Korba, 2333-A N. Fiarview, Burbank, Calif. 91505

[22] Filed: Aug. 8, 1975

[21] Appl. No.: 603,131

[52] U.S. Cl. ..... 339/26; 324/16 T; 339/28; 339/153

[51] Int. Cl.[2] ..... H01T 13/04

[58] Field of Search ..... 339/28, 29, 31, 32, 339/154 A, 153, , 26, 258 C, 256 C; 324/16 R, 16 T, 17; 73/118

[56] References Cited

UNITED STATES PATENTS

| | | | |
|---|---|---|---|
| 1,989,893 | 2/1935 | Taylor | 339/223 S |
| 2,835,724 | 5/1958 | Colbert | 339/26 |
| 2,853,691 | 9/1958 | McCord | 339/252 R |
| 3,058,089 | 10/1962 | Seido | 339/31 R |

*Primary Examiner*—Roy Lake
*Assistant Examiner*—Neil Abrams

[57] ABSTRACT

An adaptor to facilitate the use of an ignition timing light on internal combustion engines having spark plugs of various configurations. Readily changeable insulated fittings at its ends permit a flexible connector to be introduced into the ignition circuit between the end of a spark plug wire and its associated spark plug. An easily accessible portion of one of the fittings serves as a point of connection for the timer lead.

8 Claims, 8 Drawing Figures

Fig. 1
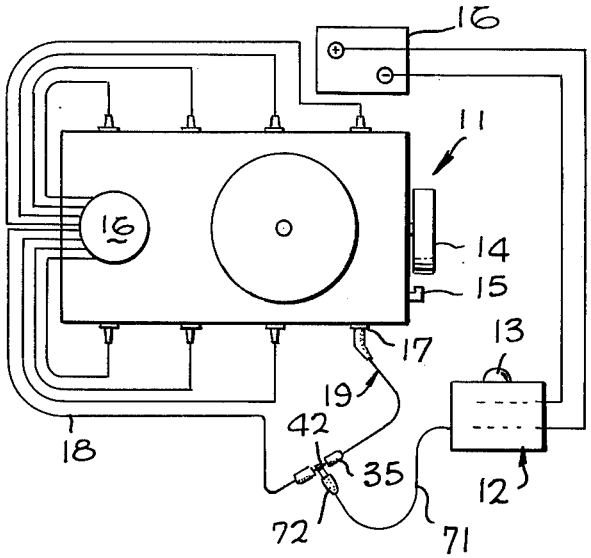
Fig. 3
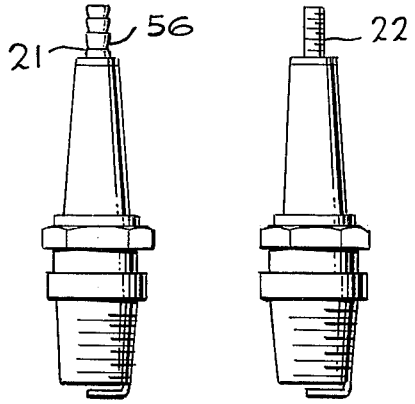
Fig. 2
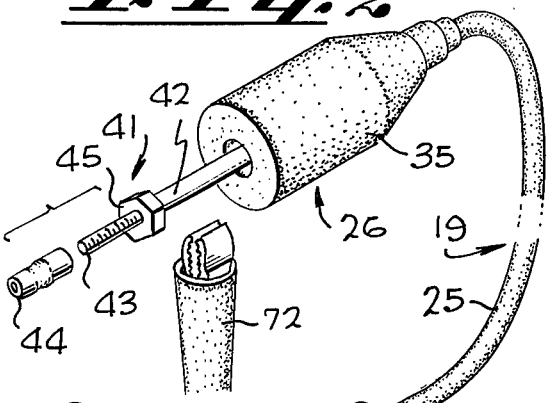
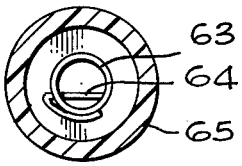
Fig. 6
Fig. 4
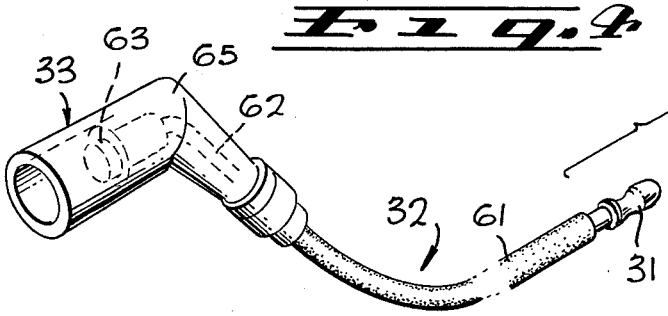
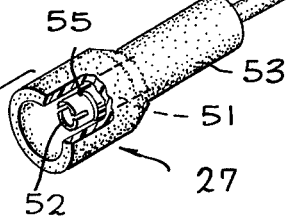
Fig. 7
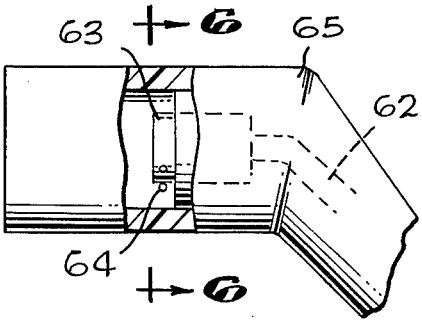
Fig. 5
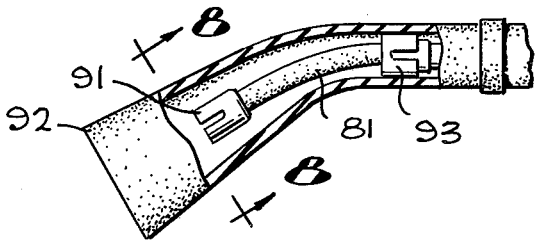
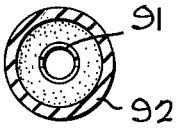
Fig. 8

TIMING LIGHT ADAPTOR

BACKGROUND OF THE INVENTION

1. Field of the Invention

The subject invention relates to the ignition timing lights for internal combustion engines, and more particularly to adaptors for connecting such lights to engines utilizing spark plugs of various configurations.

2. Description of the Prior Art

In tuning up internal combustion engines and in testing their spark plugs and related ignition systems, the mechanic must have access to the central electrode terminals of the sparks plugs or the terminals of the spark plug ignition wires.

The design of modern engines and the increasing tendency to add more and more accessories to them generally make it extremely difficult to reach the spark plugs. Additionally, the central electrode terminal of each plug is usually covered by a resilient insulating protective sleeve which fits over the ceramic insulator plug and the end of the ignition wire attached to it. Frequently these sleeves become so deteriorated that they cannot be rolled back on themselves to expose the electrode terminals without being permanently damaged.

To overcome these problems, some mechanics resort to the practice of using a sharp instrument to pierce or cut the sleeve or the spark plug wire covering in order to make contact with the ignition circuit. Obviously, these methods are undesirable.

Prior art devices have been proposed which are intended to furnish access to the ignition circuit without need to damage the insulating component. A typical example of such devices is the Tune-Up Extention for Use With Spark Plugs for Testing Purposes described in McCord U.S. Pat. No. 2,853,691. Most of these devices, however, position the exposed contact surface close to the spark plug where, as with McCord's extention, it is just as inaccessible as the plug electrode terminal itself.

It is a primary object of the subject invention to furnish an electrical connector which can be quickly and easily connected in series between the terminal end of any of the spark plug wires and the associated plug's electrode terminal, and which contains a readily accessible attachment point for testing equipment such as a timing light, an oscilloscope, or one of the new-generation computerized engine analyzers.

For maximum utility, a connector of this type must be usable with all forms of internal combustion engines; but the spark plugs in such engines are not identically constructed. The electrode terminals on most automobile engine plugs are relatively large and are provided with annular detents adapted to cooperate with axially slotted resilient female slip-on terminal caps on the ends of the ignition wire leads originating at the distributor. Many sport cars and most smaller motorcycles use plugs having threaded terminals onto which the distributor or coil wire terminals are pressed.

Prior art electrical connectors have been designed for quick-mounting to spark plugs. The Electrical Connector shown in Bell U.S. Pat. No. 2,024,814 is typical of these. However, most such connectors are not usable with both types of plugs.

It is another object of the subject invention, therefor, to provide an adaptor for timing lights and similar test equipment which can be employed with plugs of both configurations.

SUMMARY OF THE INVENTION

Essentially, the subject invention comprises a flexible insulated electrical wire or cable having an insulated fitting at one of its ends to receive the terminal end of a distributor or coil wire, and a second insulated fitting at its other end to receive the terminal end of the associated spark plug. In one embodiment of the invention the first fitting is formed for use with one of the two types of plug terminals and to receive an adaptor having a fitting formed for use with the alternate type of terminal. In a second embodiment of the invention, the fitting associated with the plug is changeable to conform to the type of terminal encountered. In both embodiments the fitting associated with the distributor or coil wire is changeable to conform to either end cap configuration, and is provided with an easily accessible contact point for attachment of the test equipment lead.

The features of the invention which are novel are set forth in the appended claims. The structure and function of the invention, together with further objects and advantages thereof, may be understood best by reference to the following description, taken in conjunction with the accompanying drawings.

BRIEF DESCRIPTION OF THE DRAWINGS

FIG. 1 is a structural schematic plan view of a typical automobile engine with a timing light connected to the ignition circuit by means of the subject invention;

FIG. 2 is a side view of a spark plug having a smooth electrode terminal end;

FIG. 3 is a side view of a spark plug having a threaded electrode terminal end;

FIG. 4 is a fragmentary perspective view of one embodiment of the invention, with portions cut away to show the internal construction of certain components;

FIG. 5 is an enlarged fragmentay side view of one of the end fittings of the device illustraed in FIG. 4, with a portion cut away to show its internal construction;

FIG. 6 is a sectional view of one end fitting of FIG. 5, taken in the direction 6—6;

FIG. 7 is a fragmentary side view of an end fitting of a second embodiment of the invention, with a portion cutaway to show its internal construction; and FIG. 8 is a sectional view of the end fitting of FIG. 7, taken in the direction 8—8.

DESCRIPTION OF THE PREFERRED EMBODIMENTS

Referring now to the drawings, in tuning up a conventional internal combustion engine 11 a portable timing light unit 12 is used. The intermittent stroboscopic flashing of the lamp 13 allows the mechanic to adjust the timing by aligning an indexing mark on the engine flywheel 14 with an indicator 15 fixed to the engine block.

The timing unit 12 is conncted to, and draws its power from, the battery 16. To synchronize the lamp 13 with the engine 11, the unit 12 is connected through lead 19 in parallel with the ignition circuit between the distributor 16 and one of the spark plugs 17. The adaptor 19 of the subject invention is inserted between the end of the ignition wire 18 from the distributor and the terminal end of plug 17 to facilitate this connection.

As mentioned previously, the majority of American automobiles and a number of motorcycles employ spark plugs such as that shown in FIG. 2, having large smooth terminal ends 21, while sports cars and most smaller motor cycles have plugs like that shown in FIG. 3, with thinner, threaded terminal ends 22. The subject adaptor 19 is designed for use with either of these types of plugs. FIGS. 4–6 illustrate its preferred construction.

In the embodiment shown, the adaptor 19 includes a flexible electrically insulated wire or cable 25, having a pair of fittings 26, 27 at its ends. Fitting 26 is adapted to be connected to the terminal cap on the end of the ignition wire 18, and fitting 27 is adapted to be connected to either the terminal end 21 of a plug like that shown in FIG. 2, or the end cap 31 of an accessory connector 32, having an end fitting 33 adapted to be connected to the threaded terminal end 22 of a plug like that shown in FIG. 3.

Fitting 26 is preferably formed with an enlarged base 35 of suitable insulating material such as high-impact plastic, rubber, or the like, sized to be grasped with one hand. The surface of base 35 may be roughened or knurled to provide a surer grip.

The conductor of wire or cable 25 is connected to an elongated rigid conductor 41 having an exposed shank 42 extending outwardly of base 35. The conductor 41 is formed with a threaded end 43 of substantially the same diameter as the threaded terminal end 22 of the sports car- or motorcycle-type spark plug of FIG. 3. An internally threaded end cap 44 of conductive material is adapted to be screwed onto the end 43 of conductor 41. A nut 45 may be threaded to the end 43 to serve as a stop for cap 44. Cap 44 is preferably identical in external size and shape with the terminal end 21 of the automobile-type spark plug of FIG. 2.

Fitting 27 comprises a rigid conductor 51 connected at one end to the conductor of wire or cable 25 and terminating at its other end in a slotted tip 52 of resilient conductive material. The entire conductor 51 is covered by an elongated sleeve 53 of insulating material such as high-impact plastic, rubber, or the like, sized to be grasped with one hand, and externally roughened or knurled for ease in handling. The tip 52 is adapted to be slipped over the terminal end 21 and may be formed with an annular indentation 55 positioned to cooperate with the annular groove 56 on the terminal end 21 to insure a firm and secure grip.

Accessory connector 32 includes an insulated wire or cable 61, terminating at one end in a cap 31 of conductive material similar in size and shape to the terminal end 21, and at the other end in the fitting 33. The construction of fitting 33 is best seen in FIGS. 5 and 6.

Wire or cable 61 is connected to an elongated rigid conductor having a hollow cylindrical collar 63 at its end. The internal diameter of collar 63 is somewhat larger than the threaded terminal end 22. Detent means, such as resilient wire clip 64 extending transversely through the collar 63, retains the collar 63 firmly and securely in place when it is slipped over the terminal end 22. A sleeve 65 of insulating material such as high-impact plastic, rubber, or the like, surrounds the conductor 62 and collar 63. As with base 35 and sleeve 53 the sleeve 65 is preferably roughened or knurled for ease in gripping by hand. Sleeve 65 may be formed with a dog-leg as shown in FIG. 4 to facilitate the attachment of collar 63 to a spark plug in the close confines encountered in sports car and motorcycle engines.

When it is desired to adjust the timing of an automobile engine, cap 44 is screwed onto the end of conductor 41. An ignition wire 18 is removed from its spark plug 17, and its terminal cap (not shown) is slipped over the cap 44. The cap 52 is slipped over the terminal end 21 of the plug 17. Timing light unit 12 is connected to the battery 16, and timing lead 71 is connected to the ignition circuit by means of alligator clip 72. The shank 42 of fitting 26 is intended to serve as a convenient attachment point for clip 72. Wire or cable 25 is of sufficient length to permit timing unit 12 to be positioned adjacent indicator 15 regardless of which spark plug is selected for the timing operation.

When the operation has been completed, the adaptor 19 is removed from plug 17 by a gentle tug and the ignition wire terminal released from the fitting 27 and replaced on terminal end 21 of plug 17. Alligator clip 72 may be disconnected from shank 42 or may be left attached to fitting 26 in readiness for the next tune-up.

For setting the timing of sports car or motorcycle having plugs with threaded terminal ends 22, the cap 44 is not necessary, but the accessory conductor 32 is used. Cap 31 is inserted into the tip 52 of fitting 27 until it is engaged by detent 55. As previously described, ignition wire 18 is released from its plug 17 and attached to conductor 41, in this instance directly over the threaded end 43. The threads provide a secure frictional connection between the ignition wire end cap and the conductor end 43. Fitting 33 is slipped over the exposed end of plug 17 so that the terminal end 22 of the plug enters collar 63 and is held securely by wire clip 64. With the timing unit 12 connected to battery 16 and alligator clip 72 secured to the shank 42 of fitting 26, the timing operation is performed in the customary manner.

FIGS. 7 and 8 illustrate an alternative embodiment of the subject invention. In this configuration the fitting 27 is adapted to receive either one of a pair of similarly constructed easily replaceable rigid conductors 81, one of which, as shown, has a tip 91 simmilar to the tip 52 of FIG. 4 which conforms to the terminal end 21 of the automobile-type plug of FIG. 2, and the other of which (not shown) has a tip substantially like the collar 63 with its retaining wire clip 64 shown in FIG. 4 which conforms to the terminal end 22 of the sports car- and motorcycle-type plug of FIG. 3. For convenience in replacing the conductor 81 the insulating sleeve 92 of this embodiment is preferably made of a flexible material, such as pliable rubber, which may be rolled back on itself to expose the conductor 81 and its attachment means, e.g. socket 93.

The operation of this embodiment is essentially the same as that of the previously described form of the invention, except that instead of attaching the accessory connector 32 to fitting 27 to adjust the timing of a sports car or motorcycle, it is only necessary to insert the appropriate conductor 81 into fitting 27 and apply it directly to the terminal end 21 of the plug 17.

It will be apparent from the foregoing that while particular structures have been shown and described, other constructions may be envisioned and modifications may be made without departing from the spirit and scope of the invention as hereinafter claimed.

What is claimed is:

1. An adaptor for connecting an ignition timing light with internal combustion engines employing spark plugs of a first type, having central elctrode terminals of one configuration, and with such engines employing spark plugs of a second type, having central electrode terminals of another configuration, the terminal ends of ignition wires being releasably retained over said central electrode terminals, said adaptor comprising:

a first elongated insulated flexible electrical conductor;

a first fitting at one end of said conductor adapted to slip over and releasably retain the central electrode terminal of a spark plug of said first type;

a second fitting at the other end of said conductor adapted to slip into and releasably retain the terminal end of the ignition wire associated with said spark plug of said first type, and having an exposed portion for attachment of the timing lead from said timer;

said first fitting being adapted to receive a first connector, adapted to slip over and releasably retain the central electrode terminal of a spark plug of said second type;

said second fitting being adapted to receive a second connector, adapted to slip into and releasably retain the terminal end of the ignition wire associated with said spark plug of said second type.

2. An adaptor as defined in Claim 1 for use with engines employing spark plugs of said fist type, wherein said central electrode terminals are threaded, and for use with engines employing spark plugs of said second type, wherein said central electrode terminals are of a diameter greater than that of said first type and are generally smooth, except for one or more annular grooves therein; wherein:

said first fitting comprises a rigid conductor having a resilient, axially slotted tubular tip, sized to slip over the central electrode terminals of spark plugs of said second type;

said second fitting comprises an elongated rigid conductive rod having a threaded end of substantially the same diameter as said threaded terminals and having a conductive cap removably threaded thereon, said cap being substantially the same diameter as the terminals of said second type of spark plugs;

said first connector comprises a conductor having a tubular tip, sized to slip over central electrode terminals of spark plugs of said first type, and containing resilient detent means for releasably retaining said terminals therein.

3. An adaptor as defined in Claim 2, wherein said first fitting comprises:

a pair of interchangeable connectors, one of said connectors having a resilient, axially slotted tubular tip sized to slip over the central electrode terminals of spark plugs of said first type, and the other of said connectors having a tubular tip sized to slip over the central electrode terminals of spark plugs of said second type and containing resilient detent means for releasably retaining said terminals therein; and attachment means associated with said interchangeable connectors for releasably attaching said connectors to said first conductor.

4. An adaptor as defined in Claim 3 wherein:

said interchangeable connectors comprise a pair of elongated rigid conductive rods having said tubular tips on one of their respective ends; and said attachment means comprise sockets on the other ends of said rods adapted to slip over the end of said first conductor.

5. An adaptor as defined in claim 2 wherein said first connector comprises a second elongated insulated flexible electrical conductor having a cap at one of its ends releasably insertable into said first fitting and a tubular tip at its other end, sized to slip over the central electrode terminals of spark plugs of said second type and containing resilient detent means for releasably retaining said terminals therein.

6. An adaptor as defined in claim 2 wherein said resilient detent means comprises a wire clip extending across the bore of said tubular tip.

7. An adaptor as defined in claim 2 wherein said first fitting comprises a resilient flexible sleeve of electrically insulating material surrounding said rigid conductor and its tip.

8. An adaptor as defined in claim 1 wherein said first and second fittings comprise enlarged electrically insulated grips.

* * * * *